US005472327A

United States Patent [19]

Strikis et al.

[11] Patent Number: 5,472,327

[45] Date of Patent: Dec. 5, 1995

[54] ROTARY COMPRESSOR WITH IMPROVED FLUID INLET PORTING

[75] Inventors: Guntis V. Strikis, Belleville; Vipen K. Khetarpal, Novi; Victor G. Filipenco, Ann Arbor, all of Mich.

[73] Assignee: Ford Motor Company, Dearborn, Mich.

[21] Appl. No.: 417,539

[22] Filed: Apr. 6, 1995

[51] Int. Cl.[6] ..... F04C 2/00

[52] U.S. Cl. ..... 418/15; 418/6; 418/59

[58] Field of Search ..... 418/6, 7, 8, 11, 418/13, 15, 59, 131, 251

[56] References Cited

U.S. PATENT DOCUMENTS

| | | | |
|---|---|---|---|
| 3,695,789 | 10/1978 | Jansson | 418/75 |
| 3,791,779 | 2/1974 | Nelson | 418/30 |
| 4,286,933 | 9/1981 | Sakamaki et al. | 418/15 |
| 5,015,161 | 5/1991 | Amin et al. | 418/6 |
| 5,135,368 | 8/1992 | Amin et al. | 418/59 |
| 5,284,426 | 2/1994 | Strikis et al. | 418/6 |
| 5,370,511 | 12/1994 | Strikis et al. | 418/6 |
| 5,399,076 | 3/1995 | Matsuda et al. | 418/6 |

FOREIGN PATENT DOCUMENTS 61-8404 1/1986 Japan .

*Primary Examiner*—Charles Freay

*Attorney, Agent, or Firm*—Raymond L. Coppiellie; Roger L. May

[57] ABSTRACT

A rotary compressor having a housing with a pump cavity, an orbiting ring piston in the cavity, a cylindrical post carried by the housing within the orbiting ring, at least one pair of vanes engaging the orbiting ring to define pumping chambers in the cavity, a pair of primary fluid inlet passages communicating with the working pressure chamber during expansion of the pressure chamber, a pair of fluid outlet ports communicating with the working chambers as the volume of the working chambers contracts upon rotation of the orbiting ring piston, and a pair of secondary fluid inlet ports in parallel disposition with respect to the primary ports formed in a valve plate adjacent the orbiting ring piston whereby the orbiting ring piston registers with the ports and opens and closes the ports in synchronism with the opening end and closing of the main ports whereby the effective inlet flow capacity for the fluid into the expanding working chamber is increased.

6 Claims, 11 Drawing Sheets

ROTARY COMPRESSOR WITH IMPROVED FLUID INLET PORTING

BACKGROUND OF THE INVENTION

Climate control systems for automotive vehicles require low weight, high pressure refrigerant compressors with a relatively high volumetric efficiency. It is known compressor design practice to use a rotary orbiting piston that cooperates with a compression chamber in a compressor housing.

The rotary piston of such a compressor design rotates about an axis that is offset from the axis of the compressor cavity. As the surface of the orbiting ring piston contacts the surface of the cavity of the housing, a pumping chamber of variable volume is established. The piston cooperates with inlet and outlet ports to distribute high pressure refrigerant to an expansion valve located between the compressor and the evaporator in the climate control system. During the portion of the compression cycle in which the working pressure chamber defined by the piston and the compressor cavity is expanding in volume, the refrigerant enters the cavity. Compressor vanes extend in a generally radial direction and engage the surface of the rotary piston to effectively seal the expanding portion of the working chamber from the compression portion of the working chamber.

The improvements of our invention can be used in either a single stage rotary compressor or a double stage rotary compressor, an example of the latter being disclosed in U.S. Pat. No. 5,284,426, which is assigned to the assignee of the present invention.

The rotary piston of the compressor shown in the '426 patent includes an orbiting piston that cooperates with the compression chamber and an internal cylindrical post. This defines multiple first-stage compression chambers and multiple second-stage compression chambers. The output of the first-stage supplies the inlet of the second-stage. The orbiting ring piston, which surrounds the post of the housing wall, rotates about an axis that is offset from the axis of the post as the outer surface of the piston contacts the inner surface of the housing and the inner surface of the orbiting ring piston contacts the outer surface of the post.

There are two sets of vanes; i.e., two external vanes and two inner vanes. The external vanes, which are slidably mounted in the housing, engage the outer surface of the orbiting ring piston, thereby defining two discrete first-stage compression chambers. The inner vanes, slidably mounted in the post, engage the inner surface of the orbiting ring piston, thereby defining two discrete second-stage compression chambers.

The two compression chambers for each stage are divided and are dynamically sealed, one with respect to the other, at the tangent contact points between the piston and the housing and between the piston and the post.

BRIEF DESCRIPTION OF THE INVENTION

Our present invention can be applied to a single-stage rotary compressor or to a two-stage rotary compressor. For purposes of explaining a preferred working embodiment of the invention, reference will be made in the specification to a two-stage rotary compressor of the type disclosed in the previously mentioned '426 patent.

The inlet porting of the first-stage of the two-stage compressor causes a pressure drop due to the orificing effect of the inlet porting, especially when the rate of flow of refrigerant through the compressor is relatively high. According to a principal feature of our invention, we have provided an auxiliary inlet port situated in a compressor refrigerant flow path that is parallel to the flow path provided by the principal inlet porting. The auxiliary parallel porting arrangement is achieved by using a wear plate between the rotor and the stationary compressor cavity wall defined by the compressor housing. The wear plate has an intake opening for suction gas which registers with the rotor as the latter follows an orbiting path within the compressor cavity.

When the rotor is moved in its orbiting path in such a way that the cavity defined by the rotor and the surrounding wall of the compressor cavity is expanding, the auxiliary opening in the wear plate is uncovered, thereby admitting refrigerant through the auxiliary port into the expanding cavity. This flow complements the flow through the principal inlet port that is formed in the stationary portions of the compressor. When the rotor continues rotating in its orbital path, the cavity in the compressor that was filled with refrigerant during the suction stage of the refrigeration cycle will decrease in volume.

The auxiliary ports register with the rotor, thereby sealing the openings in the wear plate as the compression phase of the refrigeration cycle begins.

The orbiting rotary piston cooperates with the compression chamber and the internal cylindrical post to define multiple first-stage compression chambers and multiple second-stage compression chambers. The auxiliary or secondary porting of the invention, however, is used only in the primary compressor stage since the output of the primary or first-stage supplies the inlet of the second-stage. A reduction in the pressure drop that occurs by reason of the auxiliary porting, however, improves the pumping efficiency of both stages.

According to another feature of our invention, the auxiliary porting is achieved by a wear plate that protects the rotor, which typically would be formed of cast aluminum, against excessive wear at locations that otherwise would constitute wear points between the cast iron housing and the rotor. A similar wear plate is provided between the rotor and the post within which the inner vanes are slidably mounted. A third wear plate provides a friction surface that is engaged by the axial surfaces of the inner vanes.

The wear plate in which the openings for the secondary porting are formed has extensions at the locations of the outer vanes for the compressor. Thus, the axial surfaces of the outer vanes can engage these extensions, thereby reducing wear as the outer vanes reciprocate in a generally radial direction as the piston rotates in its orbital path.

FIG. *7a* through FIG. *7k* show in schematic form the post, the compressor cavity and the orbiting ring piston, as well as the inner vanes and the outer vanes, for the compressor that is illustrated in FIGS. 1–4.

PARTICULAR DESCRIPTION OF THE INVENTION

Figure 5:
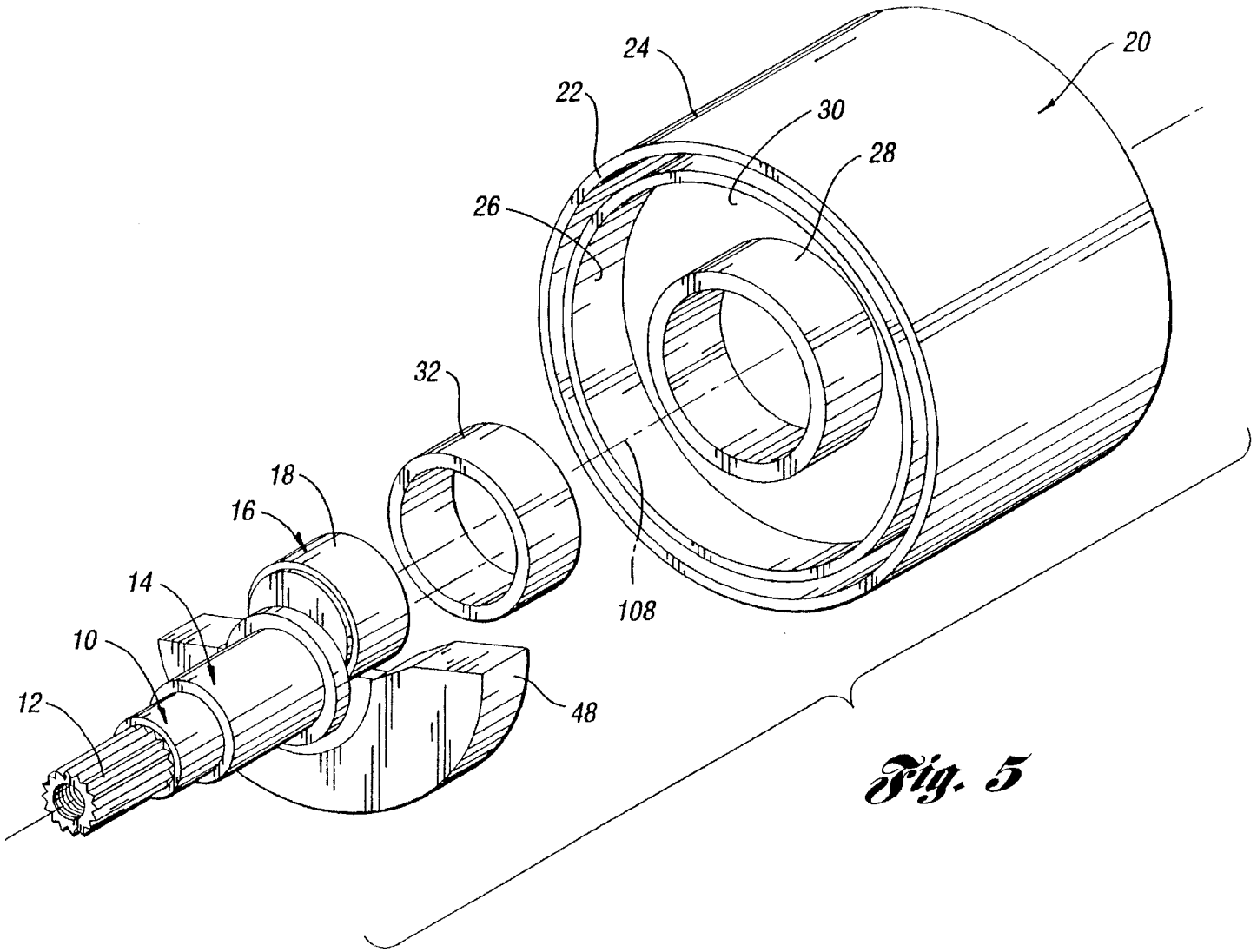
FIG. 5 is an isometric view showing the crank and the crank driver for driving the orbiting ring piston, the crank and the driveshaft being illustrated in exploded fashion for purposes of clarity.

In FIG. 5, the driveshaft for the orbiting ring piston is identified by reference numeral 10. It comprises a spline portion 12 adapted to be connected to a drive pulley, not shown, driven by the vehicle engine crankshaft. A cylindrical bearing portion 14 is adapted to be received in a cylindrical bearing opening formed in the compressor housing to be described subsequently.

A crank portion 16, seen in FIG. 5, comprises an outer cylindrical surface 18, which is received in a bearing opening formed in the orbital ring piston, as will be explained subsequently. The axis of the cylindrical surface 18 is offset from the axis of the shaft 10.

FIG. 5 shows the driveshaft with the crank portion and the orbital ring piston in isometric, spaced relationship.

The orbiting ring piston is identified generally by reference numeral 20. It comprises an outer ring 22 having a cylindrical outer surface 24 and a cylindrical inner surface 26. A cylindrical boss 28 is concentrically positioned with respect to the cylindrical surfaces 24 and 26. It is connected to the ring 22 by a radial web 30.

The boss 28, when the orbiting ring piston is assembled on the shaft 10, surrounds surface 18. A bearing 32 is located between surface 18 and the inner cylindrical surface of the boss 28, thus rotatably supporting the orbiting ring piston 20 on the crank portion 16.

Figure 1:
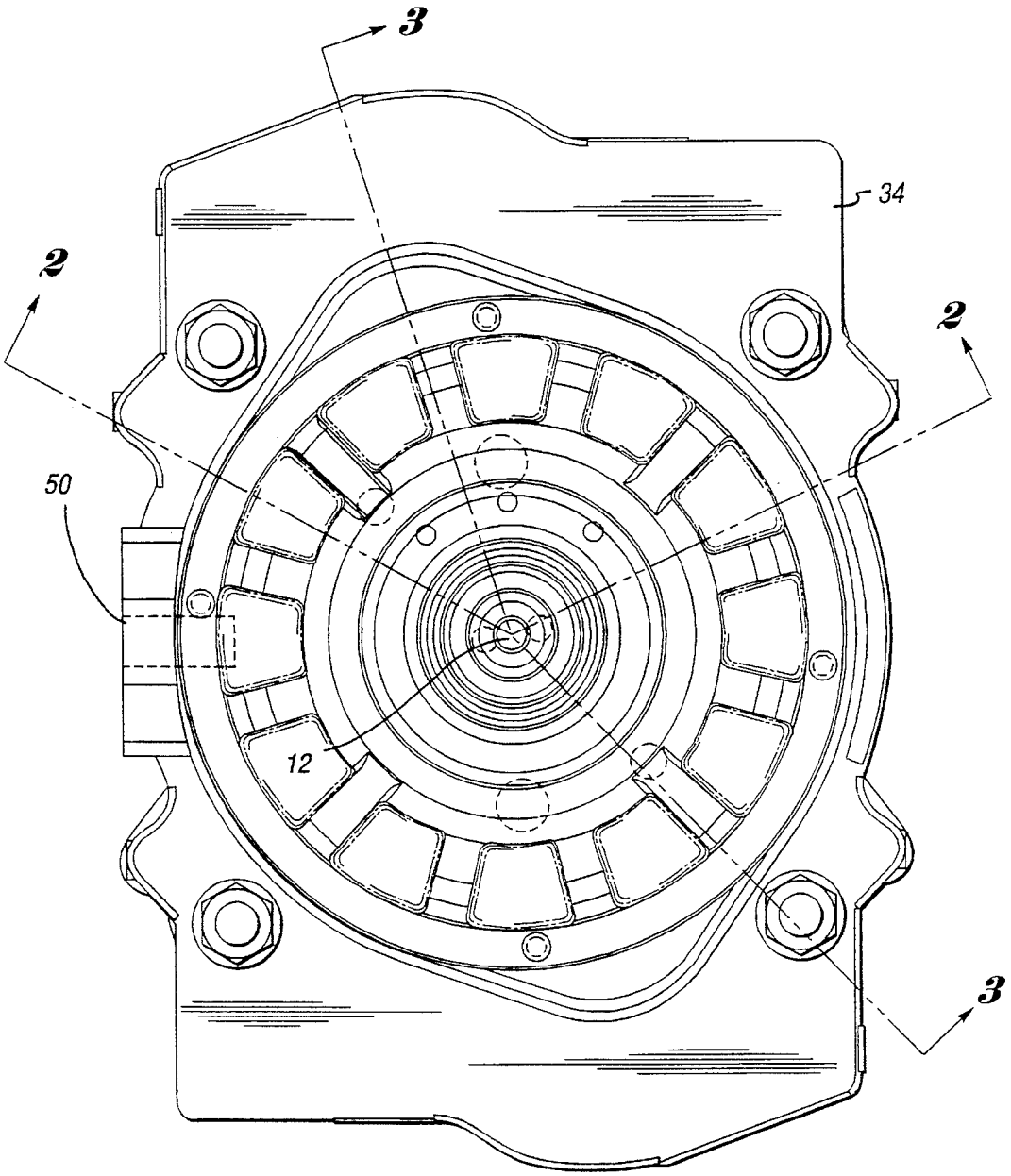
FIG. 1 is an end view of a compressor embodying the improvements of our invention.
Figure 2:
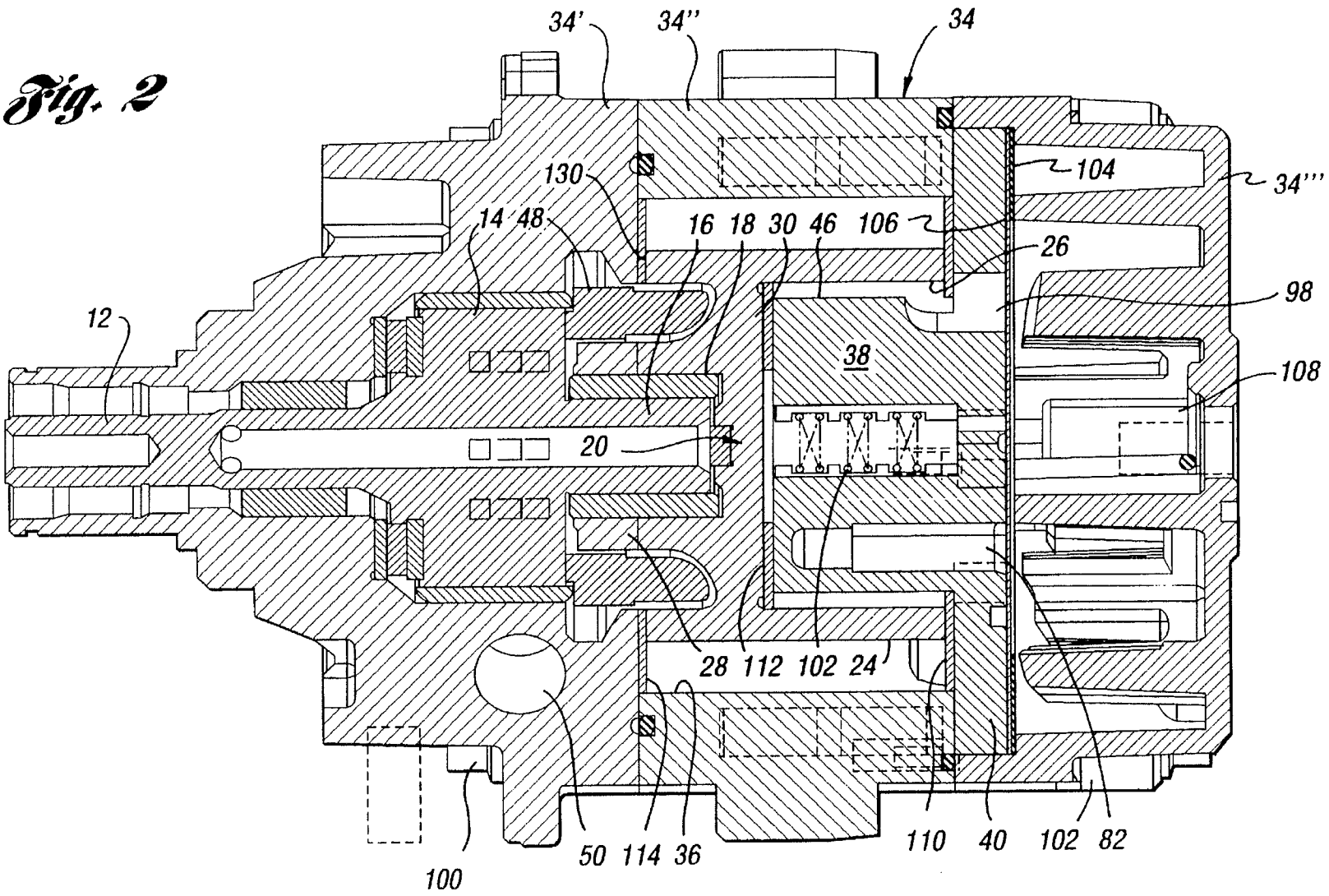
FIG. 2 is a cross-sectional view taken along the plane of section line 2—2 of FIG. 1.
Figure 3:
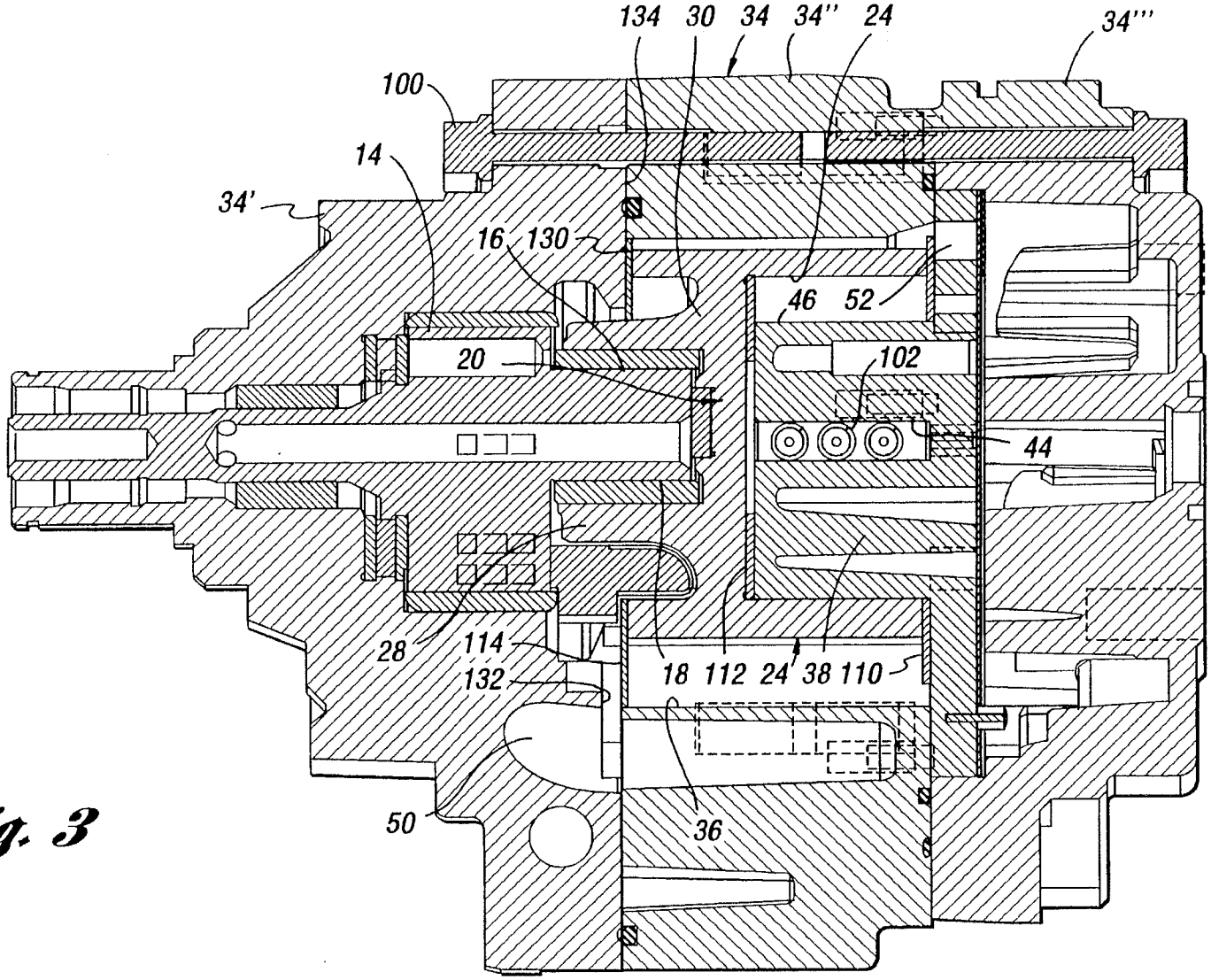
FIG. 3 is a cross-sectional view of the compressor of FIG. 1 as seen from the plane of section line 3—3 of FIG. 1.

The compressor housing is identified generally by reference numeral 34 in FIGS. 1–3. It comprises a cylindrical compressor pumping chamber 36, which receives a cylindrical post 38. The post has a cylindrical outer surface that is concentric with respect to the inner surface of the pumping chamber 36.

FIGS. 2 and 3 show a cross-sectional view of the post. It comprises a plate extending radially, as shown at 40. Plate 40 is secured to the housing on one axial side of the housing chamber 36. Cylindrical post 30 forms a part of the plate 40. A vane slot 44 extends diametrically through the cylindrical post 42. As will be explained with reference to FIGS. *7a* through *7k*, the cylindrical surface 46 of the post 38 is in engagement with the inner cylindrical surface 26 of the orbital ring piston as the outer cylindrical surface 24 of the orbital ring piston contacts the inner cylindrical surface of the housing chamber 36.

As seen in FIG. 5, a counterweight 48 is carried by the shaft 10 adjacent the crank portion 16. As the shaft 10 rotates, the centrifugal force due to the rotating members located on the axis of the boss 28 is counteracted and balanced by the centrifugal force created by the counterweight 48.

In FIGS. *7a* through *7k*, the housing opening 36, the post and the orbital ring piston are shown schematically. The orbital ring piston, the post and the chamber 36 cooperate to define first and second pumping stages. The suction port for the first pumping stage is shown at 50. The outlet port for the first-stage is formed in the housing 34 at 52. The cylindrical outer surface 24 of the orbiting ring piston contacts the cylindrical inner surface of the housing chamber 36 at contact point 54 when the orbital ring piston is in the position shown in FIG. *7a*. The outer cylindrical surface of the post 38 contacts the inner cylindrical surface 26 of the orbital ring piston at point 56.

The housing 34 is formed with a slot 58 that receives a first outer vane 60. The vane 60 is adapted to move in a generally radial direction with respect to the center of the post 38. Light springs 62 act on the radially outward end of the vane 60 and urges the vane into contact with the cylindrical outer surface 24 of the orbital ring piston as shown at 64. This spring force complements the force of pressure distributed to the radially outward surface of the outer vanes through vane slots 59 and 59' seen in FIG. *7a*.

The vane 60 has a valve recess 66 which registers with suction port 50. When the vane 60 moves in a radially inward direction, the recess 66 provides communication between suction port 50 and a gas chamber 68 located between the inner cylindrical surface 36 of the housing and the outer cylindrical surface 24 of the orbital ring piston.

Located approximately 180° from the slot 58 is a second slot 58' formed in the housing 34. A second outer vane 60' is slidably positioned in the slot 58'. The inner end of the vane 60' engages the outer surface 24 of the orbital ring piston, as shown at 64'. A second first-stage outlet port 52' communicates with a crescent shape gas chamber defined by the inner surface of chamber 36 of the housing and the outer surface 24 of the orbital ring piston. It is located directly adjacent vane 60'. Likewise, the port 52 is located directly adjacent vane 60.

The vane 60' has a valve recess 66' which registers with suction port 50'. When vane 60' is positioned as shown in FIG. *7a*, communication is established between suction port 50' and crescent shaped chamber 70 defined by the outer surface of the orbital ring piston 24 and the inner cylindrical surface of the opening 36. This crescent shaped chamber corresponds to crescent shaped chamber 72 located between the first-stage outlet port 52' and the vane 58.

As the orbital ring piston rotates in its orbital path in the direction of the arrow "ω" as shown in FIG. *7a*, the crescent shaped chamber 72 will progressively decrease in volume as the crescent shaped chamber 70 decreases in volume. This will be explained subsequently. Gas that passes through the port 52 flows through a one-way flow valve (not shown). The one-way flow valve will permit transfer of refrigerant gas from the crescent shaped chamber 70, but will prevent reverse flow. Likewise, port 52' accommodates the flow of gas from the chamber 72'. A one-way flow valve (not shown) is located in the port 52' to prevent reverse flow as in the case of the port 52.

A second-stage pumping chamber of crescent shape is shown at 74. It is defined by the outer surface of the post 38 and the inner cylindrical surface 26 of the orbital ring piston 20. It extends from contact point 56 to contact point 76 for a first inner vane 78.

Vane 78 is slidably positioned in the vane slot 44, as mentioned earlier. It comprises a valve slot 80 which establishes communication between second stage inlet port 82 and crescent shaped chamber 74. The radially outward edge of the valve slot 80 defines a valve land 83 that registers with a valve land 84 formed on the edge of the second-stage inlet port 82. In a similar fashion, the radially inward edge of the vane slot 66 of the outer vane 60 defines a valve land 86 which registers with valve land 88 formed at the edge of the suction pot 50.

A second inner vane for the second-stage is shown at 90, which is located 180° out of position with respect to the vane 78. Vane 90 and vane 78 are located in the common vane slot 44. The outer edge of the vane 90 engages the inner cylindrical surface 26 of the orbital ring piston, as shown at 92. Another second-stage gas chamber 94 is defined by the outer cylindrical surface of the post 38 and the inner cylindrical surface 26 of the orbital ring piston.

Chamber 94, as seen in FIG. *7a*, extends from contact point 56 between the inner cylindrical surface 26 and the outer cylindrical surface of the post 38 to the contact point 92 for the inner vane 90.

A second-stage outlet port 96 communicates with chamber 94 as the piston travels in its orbital path. Another second-stage outlet port 98 communicates the crescent shaped pumping chambers defined by the inner surface 26 of the orbiting ring piston and the outer surface of the post 38. In the position of the orbital ring piston shown in FIG. *7a*, the crescent chamber 100, which corresponds to either of the second-stage chambers 94 or 74 in the angular disposition of the compressor elements shown in FIG. *7a*, extends from contact point 92 for the vane 90 to contact point 76 for the vane 78.

Light springs 102 located in slot 44 urge the inner vanes 90 and 78 into contact with the inner surface 26 of the orbital ring piston.

A second-stage inlet port is shown at 104. This corresponds to the second-stage inlet port 82. The second-stage inlet port 105 communicates with the first-stage outlet port 52 through internal porting and passages formed in the housing 34. Similarly, the first-stage outlet port 52' communicates with second stage inlet port 82 through internal porting and passages formed in the housing 34. The internal porting and passages are not specifically disclosed in the drawings. It would correspond, however, to the inlet porting and passages described in U.S. Pat. No. 5,015,561, previously described. Reference may be made to that patent to supplement the description in this specification.

For purposes of describing the operation of the compressor, the position of the orbiting ring piston is shown in successive angular positions in FIGS. *7a* through *7k*. In FIG. *7a*, the orbiting ring piston is in a so-called "zero" angular position. If the orbiting ring piston is rotated 30° in a clockwise direction from the position shown in FIG. *7a*, the orbiting ring piston, the vanes, the post and the housing ports will assume the relative positions shown in FIG. *7b*. At that time, contact point 54 is displaced 30° relative to the vertical axis. The horizontal and vertical axes intersect at the center 108 of the driveshaft 10.

As seen in FIG. *7b*, chamber 68 increases in volume relative to the volume indicated at FIG. *7a*. Further, the outer vane 60 is moved radially inward as the lands 86 and 88 of the outer vane 60 prepare to establish communication between suction port 50 and the chamber 68. Similarly, the space 72 decreases in volume as the vane 60' moves outwardly. The gas that is compressed in the chamber 72 upon a decrease in the volume of the chamber 72 is pumped through the first-stage outlet port 52' and through a one-way flow valve into the second-stage inlet port 82, suitable internal passage structure being formed in the housing 34 for this purpose.

Simultaneously with the displacement of the orbiting ring piston 30° in a clockwise direction, the chamber 94 defined by the inner surface of the orbiting ring piston and the outer surface of the post decreases in volume as the chamber 100 increases in volume. The gas that is compressed in chamber 94 is discharged through the second-stage outlet port 96. The second-stage inlet port admits refrigerant gas into the chamber 100 through a valve recess 106 formed in the vane 90. Vane 90 has a valve land 108 that registers with land 110 formed in the slot 44. Second stage outlet port 98 has a one-way flow valve that prevents reverse flow of refrigerant gas into the expanding chamber 100.

As the orbital ring piston moves from approximately the 30° position of FIG. *7b* to approximately the 50.85° position shown in FIG. *7c*, the chamber 100 decreases in volume and the pressure thus created in the chamber 100 opens the one-way flow valve for the second-stage outlet port 98. This occurs as second-stage outlet port 96 continues to discharge gases through its one-way flow valve as the chamber at 94 decreases in volume.

The outer vane 60 allows communication between the suction port 50 and the expanding chamber 68. Further, the other outer vane 60' continues to establish communication between suction port 50' and the expanding chamber 70. This occurs as the vane 60' continues to move radially outward.

When the orbital ring piston is rotated to the 60° position shown in FIG. *7d*, the chamber 68 is expanded further in volume as the valve opening 66 continues to admit intake gas through the suction port 50 and across the valve lands 86 and 88. Chamber 72 continues to decrease in volume as gas is discharged through the port 52'. Contact point 56 between the outer surface of the post and the inner surface 26 of the orbital ring piston now is located directly adjacent the second-stage outlet port 96. The gas in chamber 94 at the same time is substantially all discharged into the second-stage outlet port. The chamber 74 is in full communication with the second stage inlet port 82 through the fully opened valve opening 80 in the vane 78. Chamber 74 continues to expand as the orbital ring piston is rotated to the 90° position in FIG. *7e* to the 120° position shown in FIG. *7f*, to the 150° position shown in FIG. *7g*, and finally to the 180° position as shown in FIG. *7h*. The one-way flow valve in the port 96 prevents reverse flow of refrigerant gas at this time.

When the orbital ring piston moves to the 210° position shown in FIG. *7i*, the valve lands 84 and 82 seal the second-stage inlet port from the chamber 74, the gas in the chamber 74 begins to be compressed, and the valve in the second-stage outlet port 96 opens. Simultaneously with this action, the volume of chamber 100 progressively decreases as fluid is pumped from the second-stage outlet port 98. When the orbital ring piston reaches the 246.20° position shown in FIG. *7j*, substantially all of the fluid in the chamber 100 is exhausted through the outlet port 98.

In the 210° position shown in FIG. *7i*, the valve lands 84 and 83 seal the chamber 74 from the inlet port 82, thereby permitting compression to take place. As the chamber 74 decreases in volume, the gases are discharged through the port 96. Simultaneously, chamber 72 begins to decrease in volume as gases in chamber 72 are discharged through the port 52'.

It is apparent from the foregoing that the pumping action occurs in two stages. Each stage has two pumping chambers. The compression chambers for the first-stage discharge into the inlet ports for the second-stage compression chambers. The gases compressed in the first-stage are compressed further in the second-stage.

As seen in FIGS. 1, 2 and 3, the housing generally indicated at 34 includes a first housing portion 34' which is bolted to the housing center portion 34" by bolts 100. As previously described, the crank portion 16, counterweight 48 and the drive shaft 12 are located in housing portion 34'. At the opposite side of the center portion 34" is a housing portion 34''' which contains internal porting at the discharge sides of the first-stage and the second stage. It is bolted to the center portion 34' by bolts 102.

A sealing gasket 105 is clamped between the housing portion 34''' and the center portion 34". Located directly adjacent the gasket 105 is a valve disc or reed valve 106 which contains the one-way flow check valve reeds for the discharge sides of the first stage and the second-stage. The discharge port for the compressor, which is shown at 108, communicates with the discharge ports for the second-stage through internal passages formed in the housing portion 34'''. A suitable fitting is used to establish a connection between the port 108 and the refrigerant delivery passage.

Located between the radial portion 40 of the post 38 and the orbital ring piston is a wear plate 110. The thickness of the wear plate 110 can be chosen as desired to control the tolerance stack-up for the assembled compressor. Further, the wear plate provides a continual bearing surface for the vanes as they reciprocate in the post 38.

A second wear plate 112 is situated between the post 38 and the adjacent radial web 30 of the orbital ring piston. The plate 112 has a central opening to minimize the contact area between the radial surface of the post 38 and the adjacent surface of the orbital ring piston. A third plate 114 is situated between housing portion 34' and the adjacent surface of the orbital ring piston. This plate, which is illustrated in detail in FIG. 6, comprises a flat annular portion 116 and a central opening 118, the latter receiving the boss 28 formed on the orbital ring piston.

The plate 114 has generally radially extending portions 120 and 122 which are situated directly adjacent vane slots 58 and 58' in the housing portion 34". As in the case of the plate 110, the plate 114 serves as a continuous surface against which the vanes are guided as the vanes move radially inward and outward in their respective vane slots.

The plate 114 includes also refrigerant gas inlet openings 124 and 126 which are situated directly adjacent the inlet ports 50 and 50' for the first stage of the compressor cycle.

The plate 114 registers with the axial end surface 130 of the orbital piston 20.

The surface 130 of the orbital piston slides in a radial direction to close opening 126 and uncover opening 124 during the compression phase of a compressor cycle. During the intake phase, the surface 130 of the orbital piston moves in the opposite direction toward the axis of the compressor to uncover the inlet opening 126 and close opening 124.

As best seen in FIG. 3, the housing portion 34' is provided with an inlet port recess 132 in the surface 134 that is in contact with the adjacent surface of the housing portion 34". The recess creates a secondary inlet cavity that communicates with the inlet port for the first-stage of the two-stage compressor. As in the case of the recess 132 shown in FIG. 3, there is a corresponding recess in the surface 134 of the housing portion 34', which is located adjacent the other inlet port opening 126.

The openings 126 and 124 provide bypass inlet flow passages from the port 50 to the inlet chambers defined by the outer surface of the orbital piston and the inner surface of the compressor chamber 36.

Figure 7A:
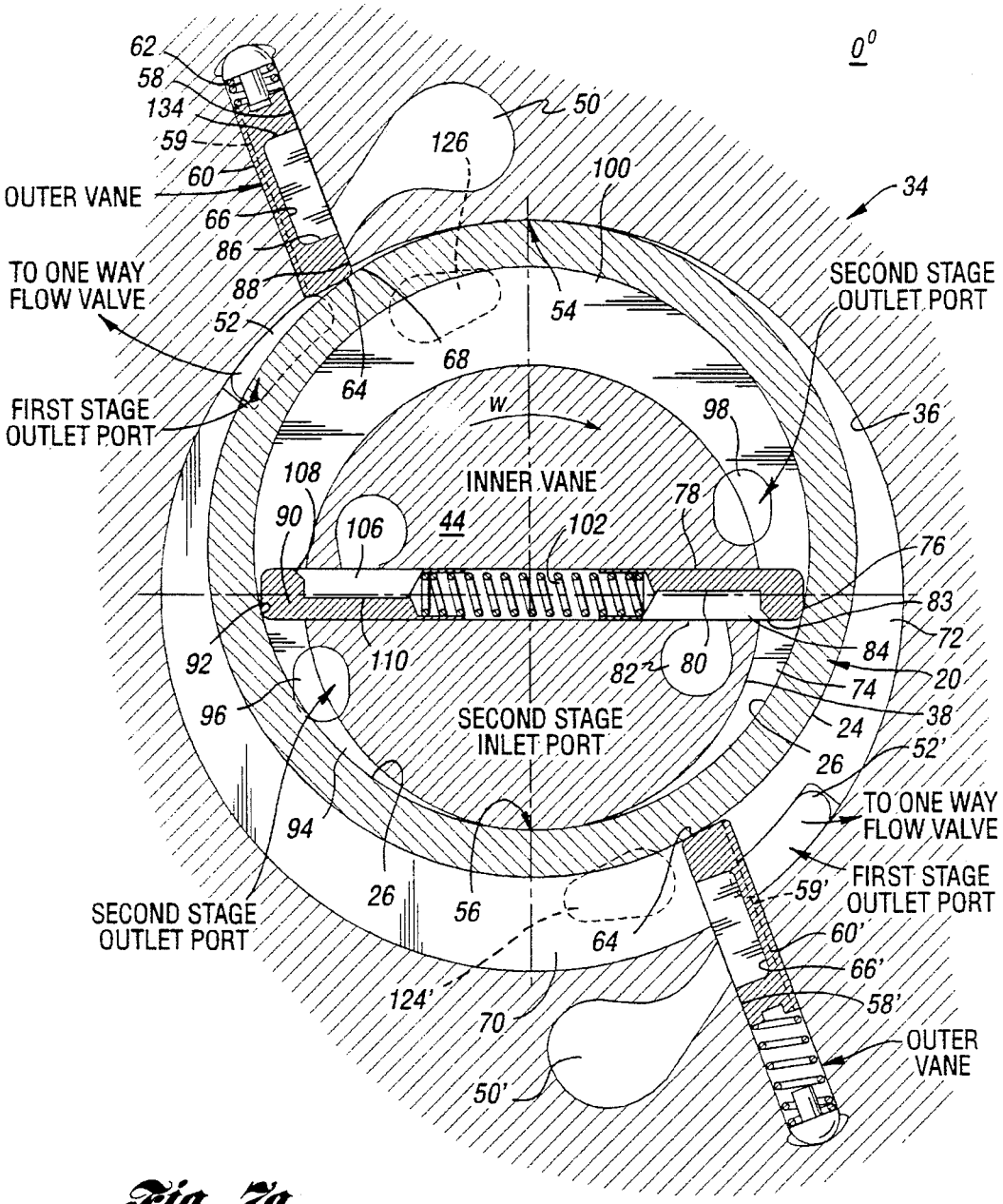
Figure 7B:
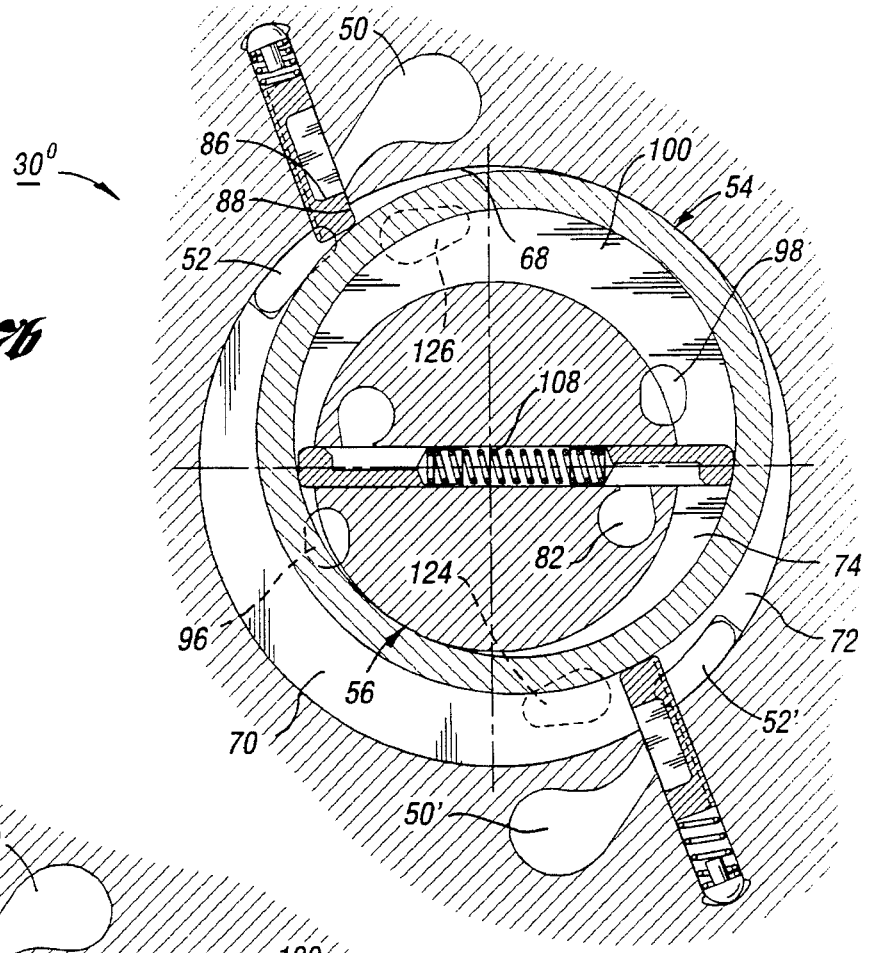
Figure 7C:
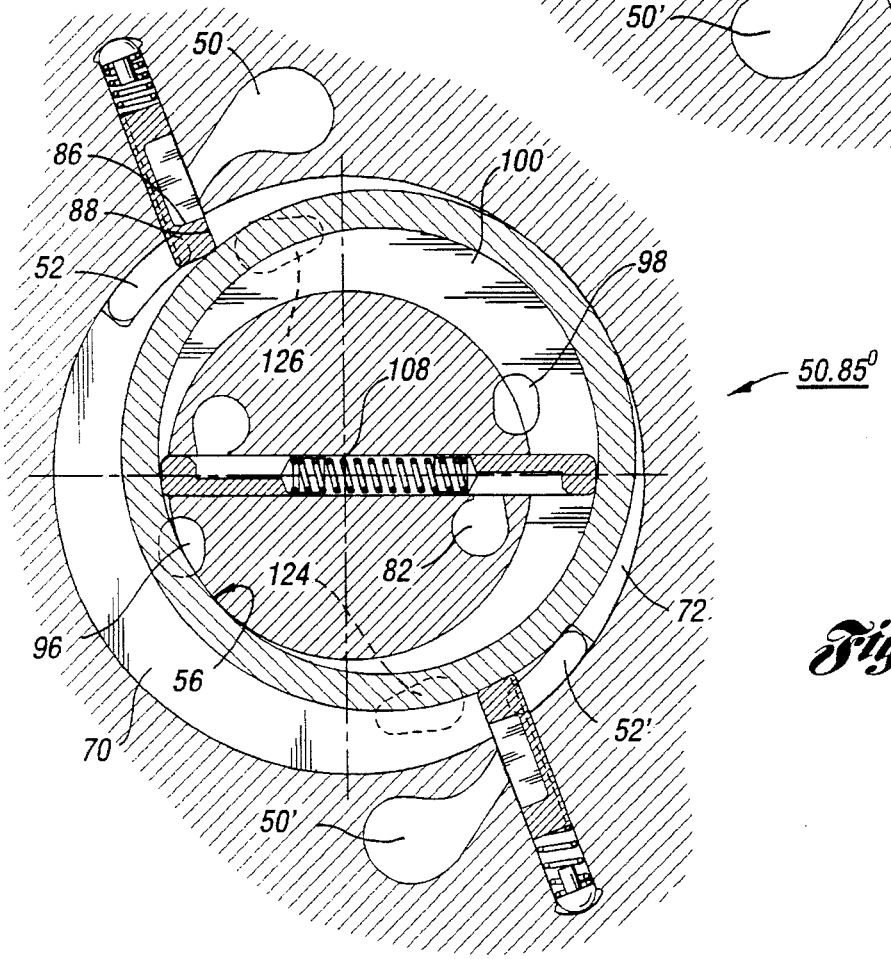
Figure 7B:
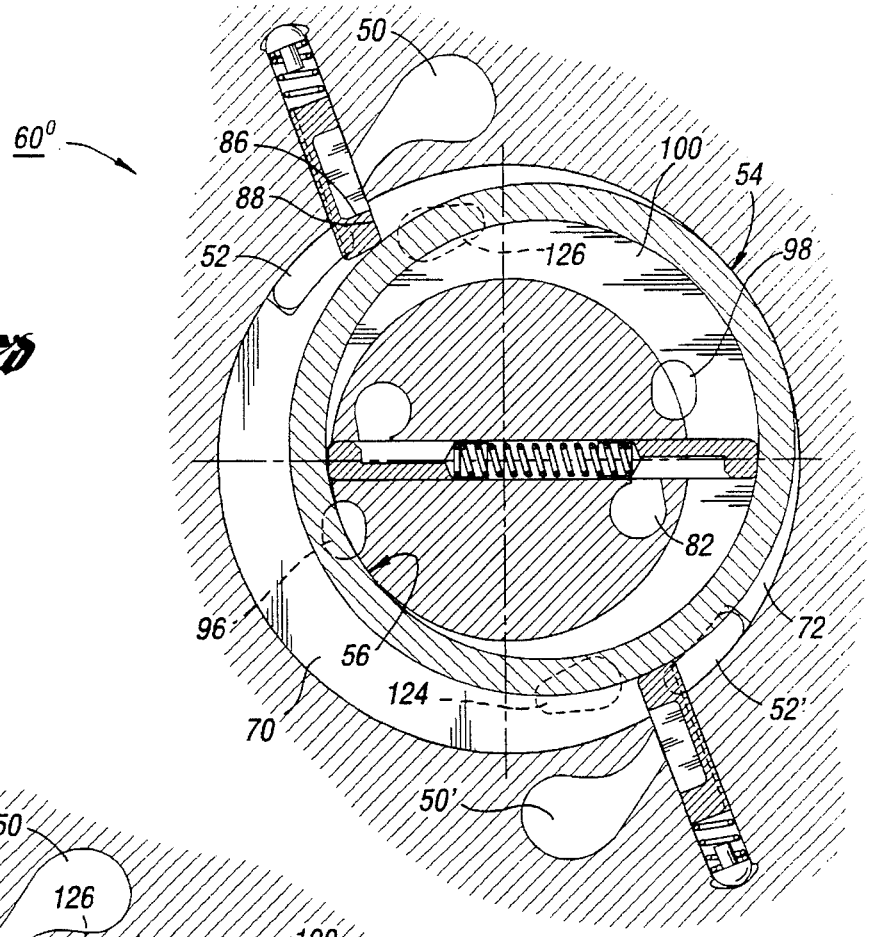
Figure 7E:
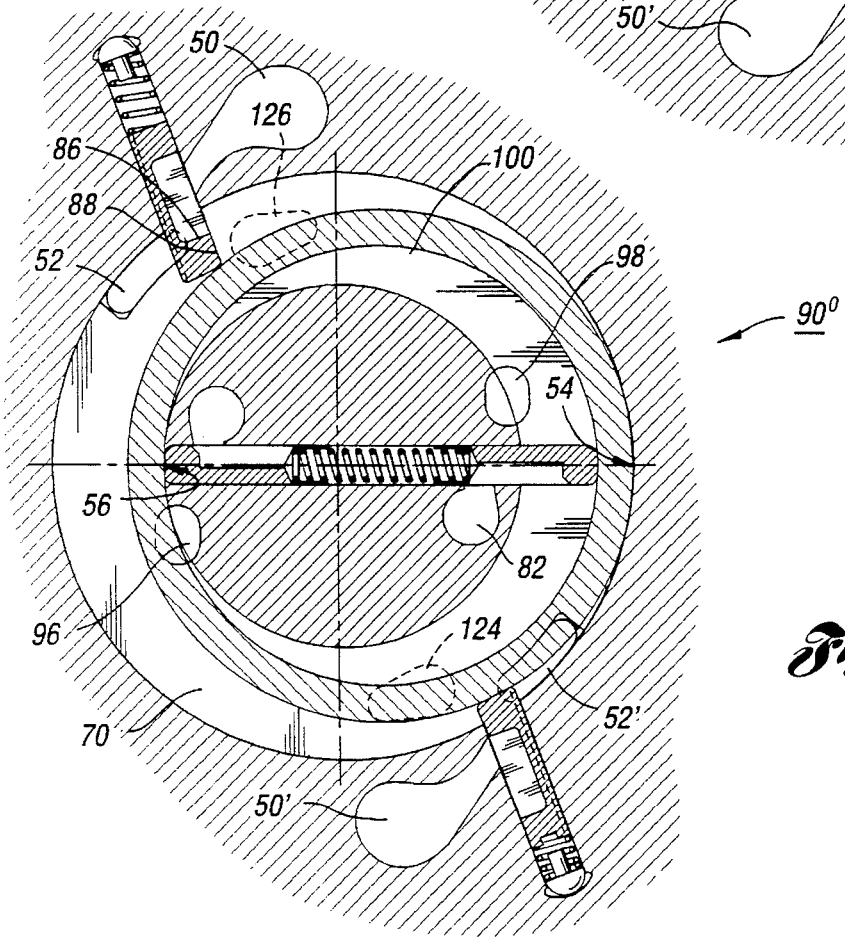

When the vane 60 is moved to the position shown in FIG. 7*a*, at which time the port 50 is blocked, the opening 126 in the plate 112 is closed. At that time, the vane 60' is in its radially inward position, thereby opening the intake port 50'. Opening 124 in the plate 112 is opened at that time. Thus the openings 126 and 124 form secondary intake flow passages to the working chambers for the first compressor stage.

Shown in schematic form in FIGS. 7*a*–7*k* are the ports 124, 126.

Figure 7F:
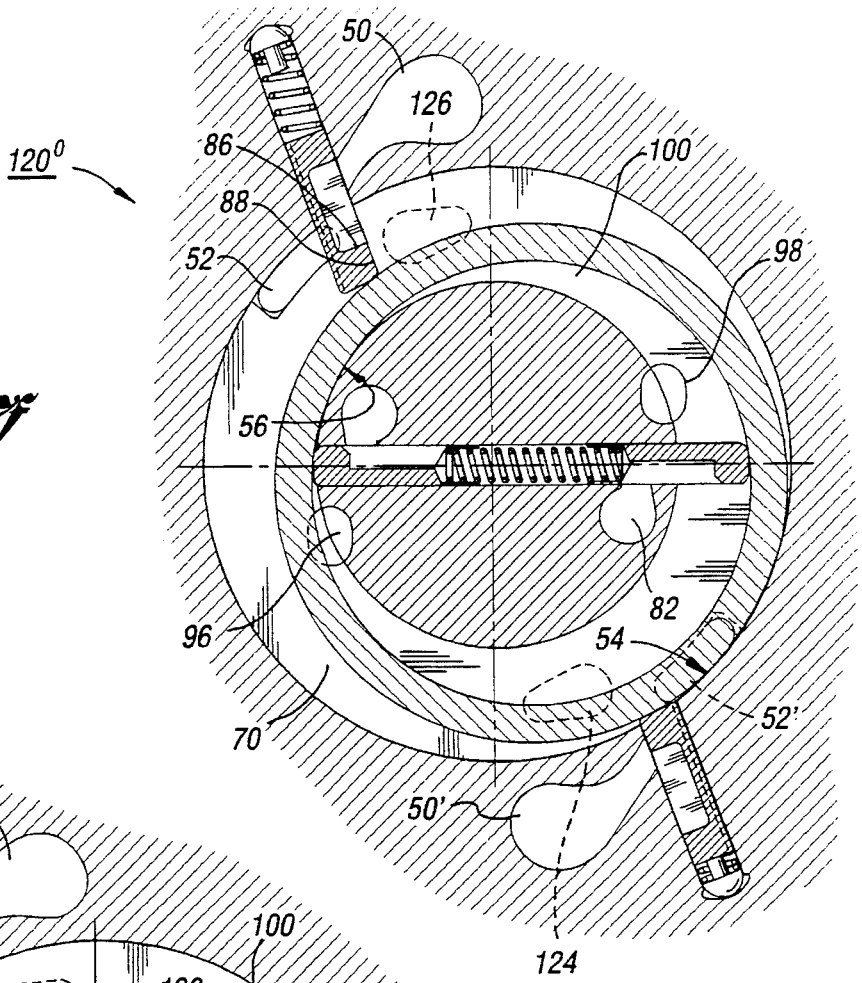
Figure 7G:
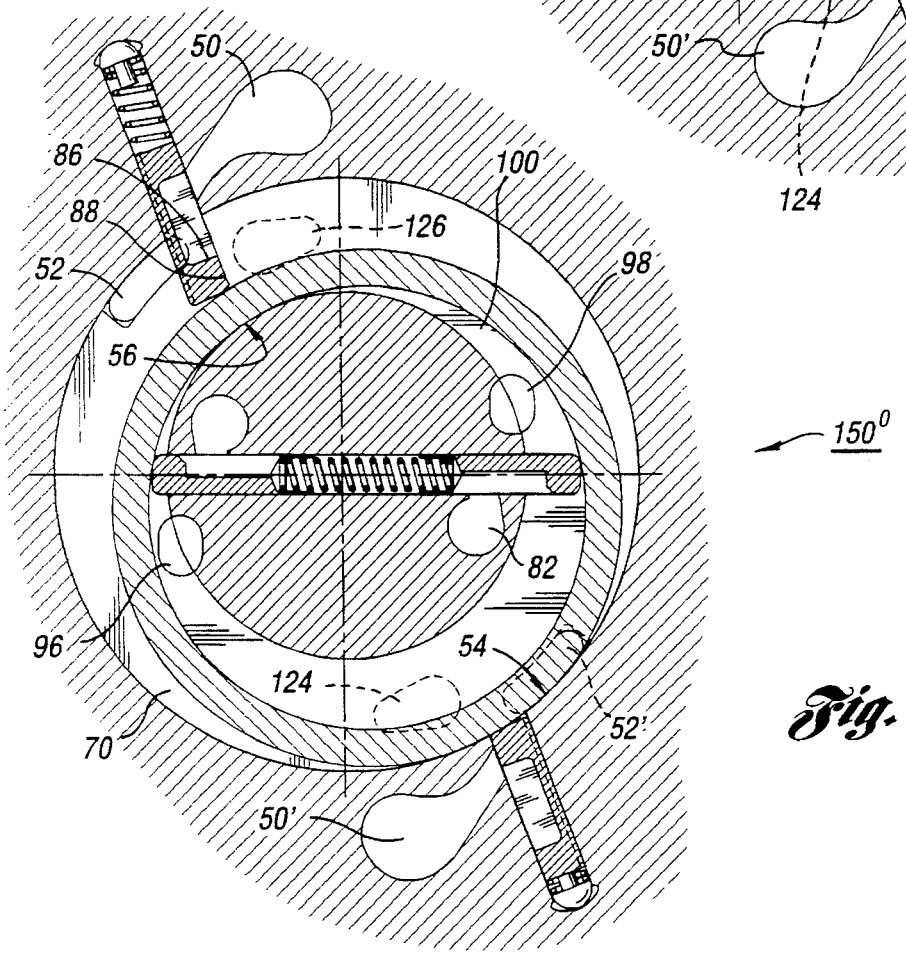
Figure 7H:
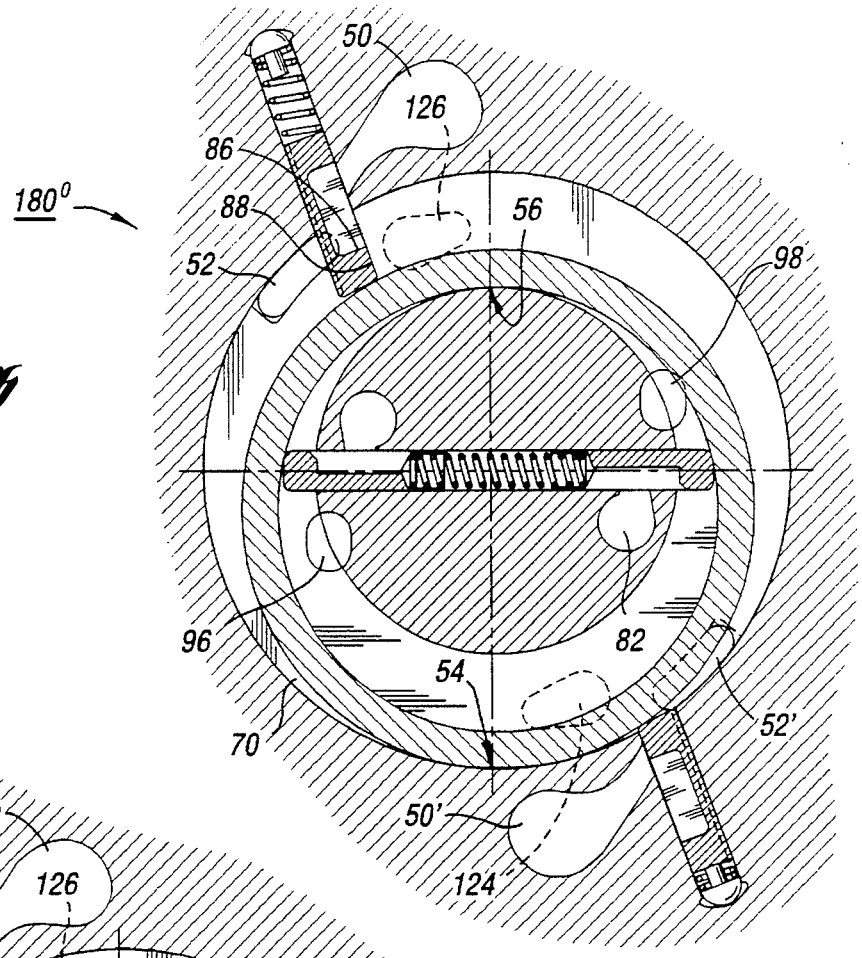
Figure 7I:
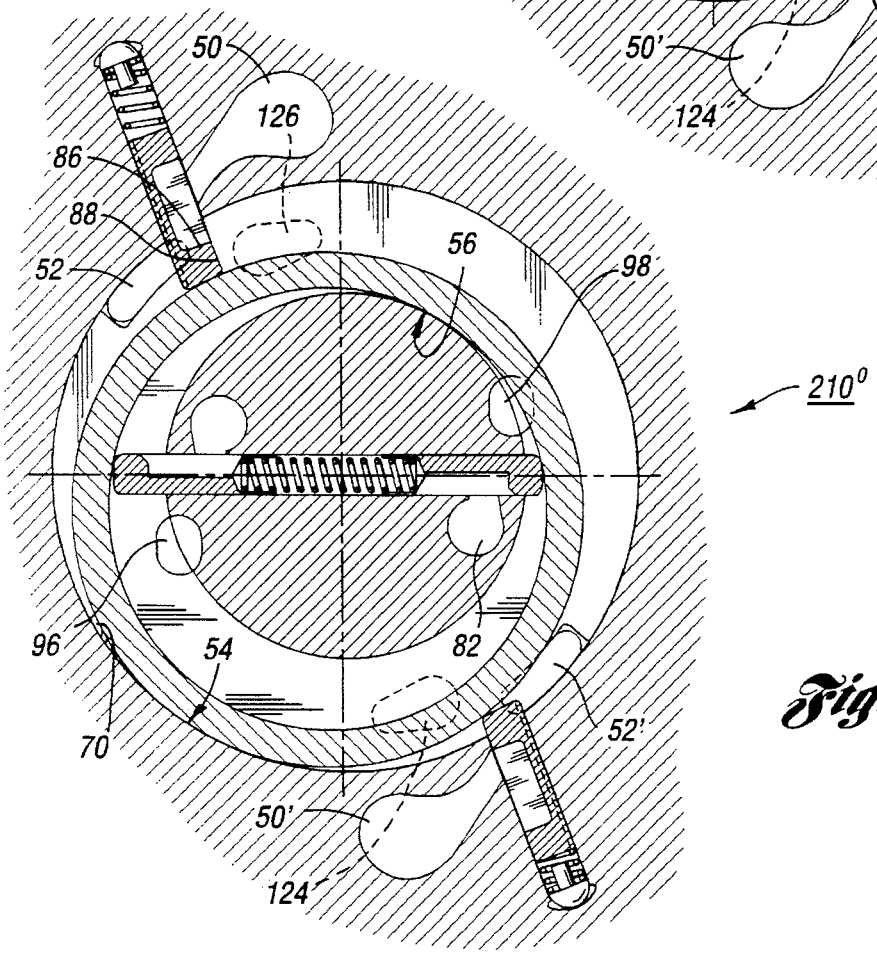
Figure 7J:
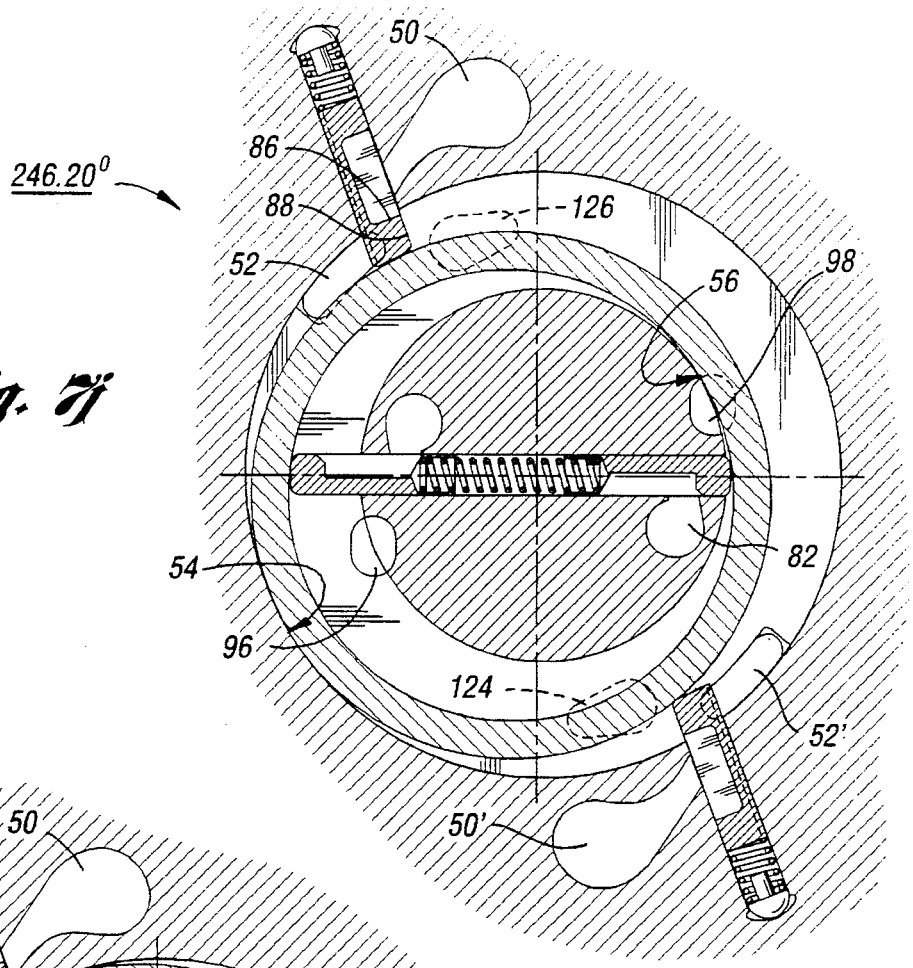
Figure 7K:
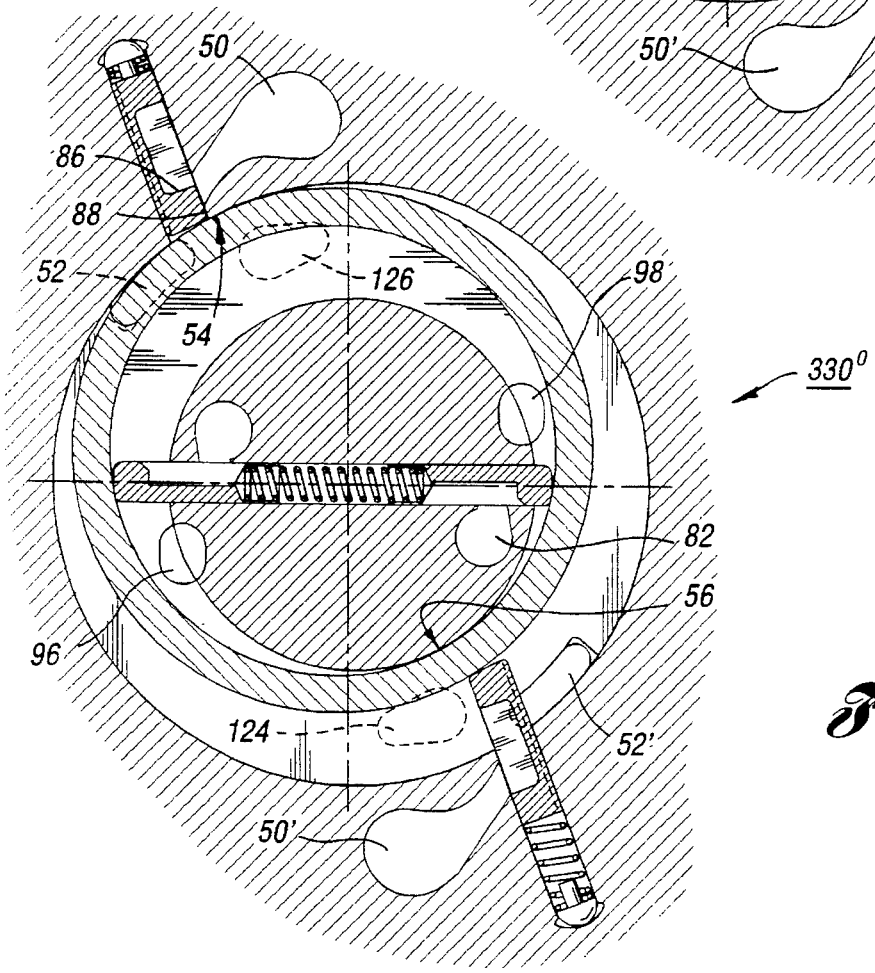

In the schematic illustration of FIG. 7*a*, the intake opening 126 is partially covered, and the intake opening 124 is fully opened. Thus, there are two flow paths from the port 50' to the working chamber for the first-stage and there is a partial bypass flow passage provided by opening 126 between the intake port 50 and the working chamber of the first-stage. In the case of the relative positions shown in FIG. 7*b*, the opening 126 is fully closed and the opening 124 is fully open. As rotation continues from the position shown in FIG. 7*b* to the position shown in FIG. 7*f*, the opening 126 is gradually uncovered. Simultaneously, the opening 124 progressively closes as the relative position of the members changes until the opening 124 is fully closed, as shown in FIGS. 7*f* and 7*g*. Finally, when the compressor components assume the positions shown in FIG. 7*k*, the opening 124 is fully opened and the opening 126 is fully closed.

Figure 4:
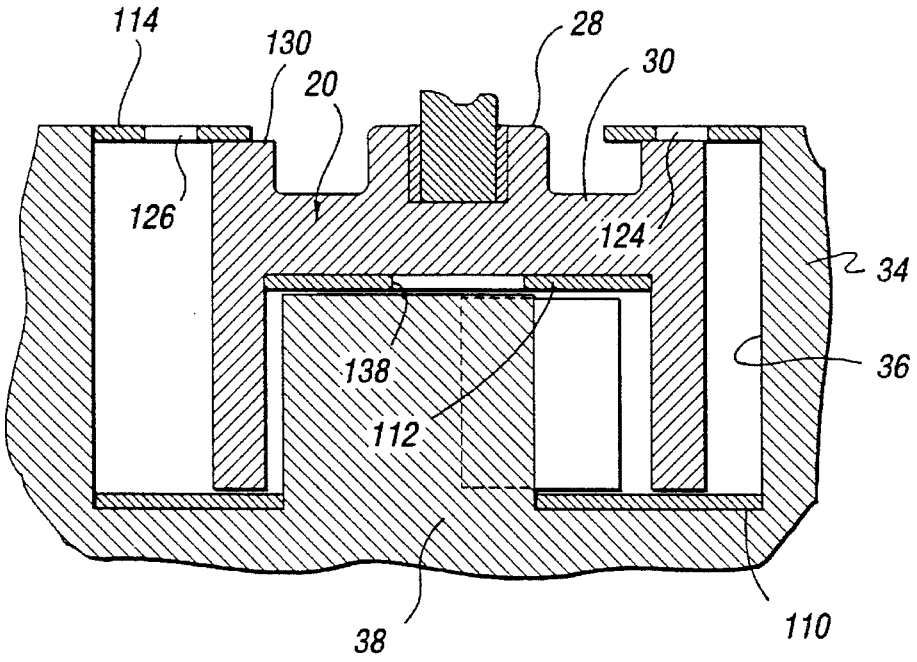
FIG. 4 is a schematic representation of the compressor cavity, the post and the rotor in assembled relationship together with the wear plates for each axial side of the rotor.

In order to illustrate more clearly the mode of operation of the rotor with respect to the plate 114, reference may be made to the schematic drawing of FIG. 4. As seen in FIG. 4, the plate 112 rests on the axial surface 130 of the orbital ring piston. The openings 126 and 124 are adapted to be closed by the orbital ring piston as the surface 130 moves in a transverse direction across the plane of the plate 112. When the orbital ring piston, which is identified in FIG. 4 as a rotor, is in the position shown in FIG. 4, the first-stage working chamber communicates with the port 50 (not shown) through the opening 126. That communication is established by the recess 132 shown in FIG. 3. Simultaneously, the rotary ring piston surface 130 moves over opening 124 to close the auxiliary intake flow passage.

The plate 112, as seen in FIG. 4, has an opening at its center, as seen at 138, to minimize the contact or film shear area as the plate engages the top of the post 38. The lower plate 110 has a central opening that surrounds the post 38.

The orbital ring piston may be formed of cast aluminum, and the post may be formed of cast iron. Thus the wear plate 112 ensures that there will not be excessive wear at the interface of the rotor and the cast iron post.

Figure 6:
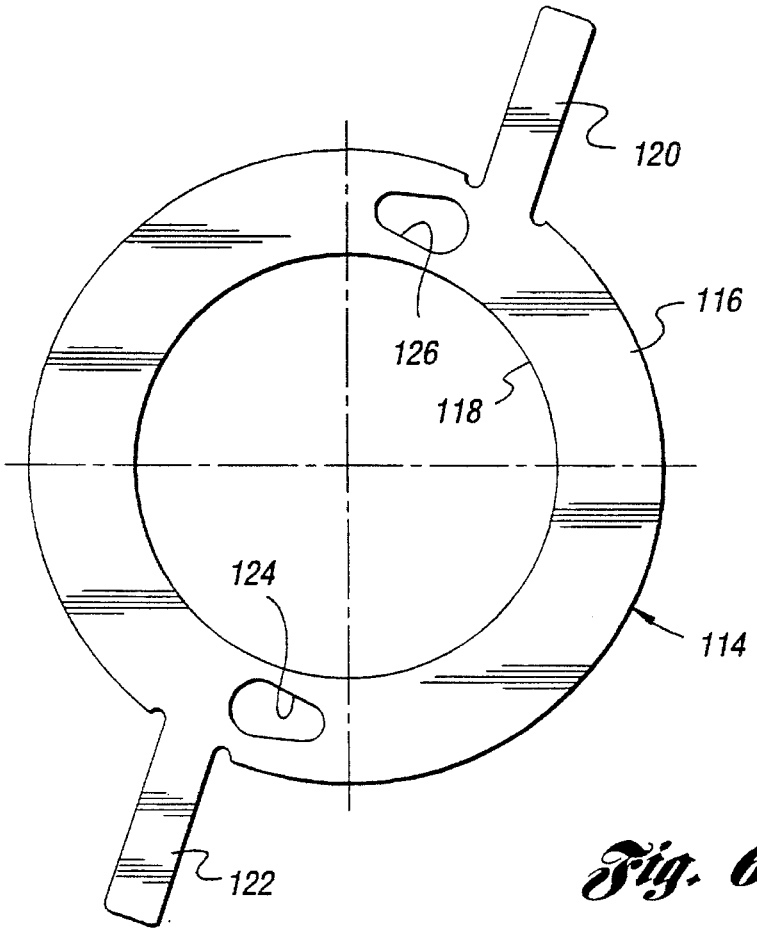
FIG. 6 is a side elevational view of the wear plate in which the openings for the auxiliary porting are formed.

Although we have described here a two-stage compressor, it will be apparent to persons skilled in the art that auxiliary porting arrangements provided by a plate such as that shown in FIG. 6 can be used in a single-stage compressor to provide an auxiliary flow path for the intake gas at the intake port.

The additional port area that is provided by the openings 124 and 126 reduces the pressure drop in the intake flow circuit, thereby improving the efficiency of the compressor. The use of a plate 112 and an appropriate modification of the compressor housing to provide an auxiliary flow passage can be incorporated into rotary compressors of known design without significant design compromises with respect to cost or space requirements.

Having described a preferred embodiment of our invention, what we claim and desire to secure by U.S. Letters Patent is:

1. A rotary gas compressor having a housing, a compressor cavity in said housing defining an internal cylindrical surface with a first axis;

a pair of slots formed in said housing and extending outwardly from said first axis, a vane slidably disposed in each of said pair of slots, each of said vanes having an inner end extending into said compressor cavity;

an orbital ring piston having an outer cylindrical surface engageable with said inner end of each of said vanes, said orbital ring piston being mounted for rotary movement about a second axis displace radially from said first axis, said outer cylindrical surface, said inner cylindrical surface and said vanes defining working fluid chambers of variable volume as said orbital ring piston rotates about said first axis;

means for driving said orbital ring piston in an eccentric, orbital path;

a pair of gas inlet ports in said housing communicating with said cavity;

a pair of gas outlet ports in said housing communicating with said cavity at a location approximately 180° out of position with respect to said gas inlet ports;

a valve plate disposed between said orbital ring piston and said housing in a plane transverse to said first axis, said plate having two gas flow inlet openings therein at locations spaced approximately 180° out of position, one with respect to the other;

said orbital ring piston sealingly engaging said valve plate and alternatively blocking and opening said gas flow inlet openings as it moves radially inward and radially outward, respectively, during motion of said orbital ring piston in its orbital path about said first axis, each gas flow inlet opening defining in part an auxiliary flow path for gas distribution to said working fluid chambers, each auxiliary flow path being in parallel flow relationship with respect to a separate one of said gas inlet ports whereby inlet gas flow pressure drop at said inlet ports is reduced.

2. The compressor set forth in claim 1 wherein said vanes define in part flow inlet valve means for controlling gas flow from said inlet ports in said housing.

3. The compressor set forth in claim 2 wherein said gas flow inlet openings complement said inlet ports by providing auxiliary gas inlet flow paths in parallel disposition with respect to gas flow paths through said inlet ports.

4. The compressor as set forth in claim 3 including spring means for urging said vanes into contact with said orbital ring piston.

5. The compressor as set forth in claim 1 including a wear plate located between said housing and one axial side of said orbital ring piston whereby axial loads on said orbital ring piston are accommodated.

6. The compressor as set forth in claim 5 including another wear plate located between the opposite axial side of said orbital ring piston and said housing, said wear plates being slidably engaged by said vanes as the latter move in their respective slots, the thickness of said wear plates determining the magnitude of the axial tolerances during assembly of said compressor.

* * * * *